US009462395B2

(12) United States Patent
Nicollini et al.

(10) Patent No.: US 9,462,395 B2
(45) Date of Patent: Oct. 4, 2016

(54) BIASING CIRCUIT FOR A MEMS ACOUSTIC TRANSDUCER WITH REDUCED START-UP TIME

(71) Applicant: STMICROELECTRONICS S.R.L., Agrate Brianza (IT)

(72) Inventors: Germano Nicollini, Piacenza (IT); Andrea Barbieri, Casalpusterlengo (IT); Federica Barbieri, Milan (IT); Alberto Danioni, Pavia (IT); Edoardo Marino, Pero (IT); Sergio Pernici, Bergamo (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 14/746,252

(22) Filed: Jun. 22, 2015

(65) Prior Publication Data

US 2016/0029129 A1 Jan. 28, 2016

(30) Foreign Application Priority Data

Jul. 22, 2014 (IT) ..... TO2014A0578

(51) Int. Cl.
*H04R 3/00* (2006.01)
*H04R 19/04* (2006.01)

(52) U.S. Cl.
CPC ..... *H04R 19/04* (2013.01); *H04R 3/00* (2013.01); *H04R 2201/003* (2013.01)

(58) Field of Classification Search
CPC ..... H04R 1/04; H04R 3/00; H04R 3/005; H04R 19/04; H04R 19/016
USPC ..... 381/113
See application file for complete search history.

(56) References Cited

U.S. PATENT DOCUMENTS 8,988,146 B1 * 3/2015 Opris ..... H03K 17/165 330/307
9,343,455 B2 * 5/2016 Gueorguiev ..... H01L 27/0248
2008/0157129 A1 * 7/2008 Hsu ..... H04R 1/04 257/254
2010/0013501 A1 * 1/2010 Van Den Boom ..... G01D 3/08 324/679
2010/0166228 A1 7/2010 Steele et al.
2010/0246859 A1 * 9/2010 David ..... G05F 1/467 381/120
2011/0142261 A1 * 6/2011 Josefsson ..... H04R 3/00 381/107
2012/0019303 A1 * 1/2012 Singh ..... H02M 1/14 327/333
2013/0195291 A1 * 8/2013 Josefsson ..... H02M 3/07 381/174
2013/0293297 A1 11/2013 Mucha et al.
2014/0064523 A1 * 3/2014 Kropfitsch ..... H03G 1/0094 381/174
2014/0079254 A1 3/2014 Kim et al.
2014/0340366 A1 * 11/2014 Poulsen ..... G06F 3/0433 345/177
2015/0110296 A1 * 4/2015 Jenkner ..... H04R 1/08 381/114

* cited by examiner

*Primary Examiner* — Simon Sing
(74) *Attorney, Agent, or Firm* — Seed IP Law Group PLLC

(57) ABSTRACT

A MEMS acoustic transducer device has a capacitive micro-electromechanical sensing structure and a biasing circuit. The biasing circuit includes a voltage-boosting circuit that supplies a boosted voltage on an output terminal, and a high-impedance insulating circuit element set between the output terminal and a terminal of the sensing structure, which defines a first high-impedance node associated with the insulating circuit element. The biasing circuit has: a pre-charge stage that generates a first pre-charge voltage on a first output thereof, as a function of, and distinct from, the boosted voltage; and a first switch element set between the first output and the first high-impedance node. The first switch element is operable for selectively connecting the first high-impedance node to the first output, during a phase of start-up of the biasing circuit, for biasing the first high-impedance node to the first pre-charge voltage.

21 Claims, 6 Drawing Sheets

BIASING CIRCUIT FOR A MEMS ACOUSTIC TRANSDUCER WITH REDUCED START-UP TIME

BACKGROUND

1. Technical Field

The present disclosure relates to a biasing circuit for an acoustic transducer, in particular a MEMS (Micro-Electro-Mechanical Systems) capacitive microphone, to which the following treatment will make explicit reference, without this implying any loss of generality.

2. Description of the Related Art

As is known, an acoustic transducer of a capacitive type, for example a MEMS microphone, generally comprises a microelectromechanical sensing structure including a mobile electrode, provided as a diaphragm or a membrane, set facing a fixed electrode, to provide the plates of a variable-capacitance sensing capacitor. The mobile electrode is generally anchored, by means of a perimetral portion thereof, to a substrate, whereas a central portion thereof is free to move or bend in response to the pressure exerted by incident sound waves. The mobile electrode and the fixed electrode provide a capacitor, and bending upwards or downwards of the membrane that constitutes the mobile electrode causes a variation of capacitance of this capacitor. In use, the capacitance variation, which is a function of the acoustic signal to be detected, is converted into an electrical signal, which is supplied as output signal of the acoustic transducer.

In greater detail, and with reference to FIG. 1, a sensing structure 1 of a MEMS capacitive microphone, of a known type, comprises a substrate 2 of semiconductor material, for example silicon; a cavity 3 (generally known as "back chamber") is formed in the substrate 2, for example via chemical etching from the back. A membrane, or diaphragm, 4 is coupled to the substrate 2 and closes the cavity 3 at the top. The membrane 4 is flexible and, in use, undergoes deformation as a function of the pressure of the incident sound waves coming from the cavity 3. A rigid plate 5 (generally known as "backplate") is set above the membrane 4 and facing it via interposition of spacers 6 (for example, of insulating material, such as silicon oxide) for defining an empty space (the so-called "air gap"). The rigid plate 5 constitutes the fixed electrode of a variable-capacitance capacitor, the mobile electrode of which is constituted by the membrane 4, and has a plurality of holes 7, for example with circular cross-section, which are designed to enable free circulation of air towards the membrane 4.

MEMS capacitive microphones require an appropriate electrical biasing so that they may be used as transducers of acoustic signals into electrical signals. In general, MEMS capacitive microphones operate in the charge-biasing condition.

In order to guarantee sufficient performance for common applications, these microphones are biased at a high D.C. voltages (for example, 15 to 20 V), typically much higher than the supply voltages at which a corresponding read circuit is supplied (logic voltages, for example of 1.6 to 3 V).

For this purpose, it is common to use voltage-booster circuits, in particular of the charge-pump type made using integrated technology, which are able to generate high voltages starting from reference voltages. In general, it is known that, the higher the biasing voltage of the microphone, the greater the resulting sensitivity of the same microphone in detecting acoustic signals.

A biasing circuit 8 that has been proposed (illustrated in FIG. 2) thus envisages a charge-pump circuit, shown schematically and designated as a whole by 9, having an output terminal 9*a*, on which a boosted voltage, or pump voltage, $V_{CP}$, is Present, that is generated starting from a supply voltage of a lower value.

The output terminal 9*a* is connected to a first terminal (constituted, for example, by the backplate 5) of the sensing structure 1 of the MEMS microphone (represented schematically with the equivalent circuit of a variable-capacitance capacitor $C_{MEMS}$), with interposition of an insulating circuit element, with very high impedance (for example, typically with a value in the region of tera-ohms), designated by 10 and represented schematically as a resistor having resistance $R_B$.

A second terminal (for example, constituted by the membrane 4) of the sensing structure 1 is instead connected to a reference potential of the circuit, for example ground.

The aforesaid first terminal consequently constitutes a first high-impedance node $N_1$ associated to the insulating circuit element 10, and is further connected to a read stage 11, illustrated schematically, which receives the voltage, designated by $V_{MEMS}$, present on the same first terminal, and generates an output voltage Vout, which is indicative of the detected acoustic signal.

The read stage 11 is usually provided in an integrated manner as an ASIC (Application Specific Integrated Circuit), in a die of semiconductor material, distinct with respect to the die in which the sensing structure 1 of the MEMS microphone is provided. The two dice may further be housed in the same package, or else in distinct packages, electrically connected together.

The biasing circuit 8 may also be integrated in the die in which the read circuit 11 is provided, or else be provided in a distinct die, which is housed in a same package.

The insulating circuit element 10 has insulation functions for the MEMS microphone, insulating the charge stored in the capacitor of the MEMS microphone starting from frequencies higher than a few hertz (in other words, the resulting cutoff frequency is well below the audio band, comprised between 20 Hz and 20 kHz). Given that, for frequencies in the audio band, the charge stored in the capacitor is fixed, an acoustic signal incident upon the membrane of the sensing structure 1 modulates the air gap and thus the voltage $V_{MEMS}$.

The presence of the insulating circuit element 10 further appropriately attenuates both the ripple and the noise at output from the charge-pump circuit 9, forming a filtering module with the capacitance of the MEMS microphone.

Given that, in a known way, it is not possible in integrated-circuit technology to provide resistors with such high values of resistance, use of nonlinear devices has been proposed which are able to provide the high resistance values for the insulating circuit element 10.

For instance, it has been proposed for this purpose to use at least one pair of diode elements in antiparallel configuration, which provide a sufficiently high resistance, when a voltage drop of a low value (depending upon the technology, for example in the region of 100 mV) is present thereon, so as not to cause them to turn on. The same diode elements may further be obtained with transistors, appropriately diode-connected.

The biasing circuit 8 further includes a switch element 12, connected in parallel to the insulating circuit element 1. The function of this switch element 12 is to overcome the problem represented by a long start-up time of the biasing circuit 8 when it is turned on, or when it returns from a so-called "stand-by" or "power-down" condition (during which the device itself is partially turned off to go into an energy-saving condition), i.e., when it is again electrically supplied.

The insulating circuit element 10, on account of the high impedance, in fact determines with the capacitance of the MEMS microphone a high time constant.

The switch element 12 may thus be selectively operated, as a function of a control signal $V_{SW}$, to provide a direct low-impedance connection between the first terminal of the sensing structure 1 and the output terminal 9*a* of the charge-pump circuit 9 (on which the pump voltage $V_{CP}$ is present), during the aforesaid start-up step.

In particular, the switch element 12 receives the control signal $V_{SW}$ from a control logic (not illustrated herein) so that it may be closed during the phase of start-up of the biasing circuit 8, and thus guarantee a fast settling of the first terminal of the sensing structure 1 to the desired biasing values, and to be open during a subsequent phase of normal operation of the biasing circuit 8, thus guaranteeing both proper biasing of the first terminal and insulation and noise performance guaranteed through the insulating circuit element 10.

The start-up phase terminates after the capacitor of the MEMS microphone is charged at the desired biasing voltage, i.e., at the pump voltage $V_{CP}$.

In other words, the switch element 12 thus enables bypassing of the insulating circuit element 10 for a certain interval of time subsequent to supply of the biasing circuit 8, and then opens and re-establishes the connection between the sensing structure 1 of the MEMS microphone and the insulating circuit element 10, when the capacitance of the MEMS microphone has reached a sufficient value of charge and the output voltage $V_{MEMS}$ has a desired D.C. biasing value.

The present Applicant has, however, realized that the biasing circuit 8 described previously has at least one drawback that does not enable full exploitation of its advantages.

This drawback is linked to the presence of parasitic currents (commonly defined as "leakage currents"), at the terminal in common between the sensing structure 1 of the MEMS microphone and the insulating circuit element 10, in the example at the first high-impedance node $N_1$ (coinciding with the first terminal of the same sensing structure 1), as represented schematically in FIG. 3, where leakage currents are designated by $I_{LEAK}$.

In a known way, leakage currents may derive, for example, from one or more of the following factors: the sensing structure 1 of the MEMS microphone; the semiconductor junctions of the transistor devices that provide the switch element 12; the electrical connection between the sensing structure 1 and the corresponding read stage 11 (given that the ASIC may be provided in a distinct die or even in a distinct package); electrostatic-discharge (ESD) protection circuits that may be present in the ASIC; or other known factors (not listed here).

In any case, it is known that leakage currents are intrinsically present and may not be avoided.

The drawback associated with leakage currents (as shown in FIG. 4) is due to the voltage drop $\Delta V$ that they cause across the insulating circuit element 10, which is high in value, even in the region of some hundreds of millivolts on account of the value of resistance of the insulating circuit element 10.

Consequently, upon opening of the switch element 12 (after a time interval designated by $t_{short}$ starting from the start of the start-up phase, of which FIG. 4 shows only a final portion, subsequent to a period of settling of the voltage $V_{MEMS}$ to the value $V_{CP}$), the capacitor of the MEMS microphone has to discharge from the initial voltage value, forced by the switch element 12, equal to the voltage $V_{CP}$, down to a new value, equal to $V_{CP}-\Delta V$, of even some hundreds of millivolts lower.

The above discharge is once again carried out with a high time constant, causing a considerable delay of time, designated by $t_d$, which determines an undesirable lengthening of the start-up time interval, designated by $t_{start\text{-}up}$.

Such long delay times may not be accepted in a wide range of situations of use of the MEMS microphone, when it is desirable to guarantee the nominal performance (and in particular a substantially constant sensitivity) with extremely short delays, both upon turning-on of the electronic device incorporating the MEMS microphone and upon re-entry from a standby or power-down condition.

As a possible solution to this drawback, the use of an insulating circuit element 10 with lower impedance, for example in the region of some tens of giga-ohms, has been proposed, thereby generating a lower voltage drop $\Delta V$ and a consequently shorter delay of time $t_d$.

However, this solution also entails an undesirable increase in noise in so far as the lower value of impedance of the insulating circuit element 10 degrades the signal-to-noise ratio (SNR) in a way not acceptable for applications in which high performance is highly desirable.

BRIEF SUMMARY

According to the present disclosure, a biasing circuit for a MEMS acoustic transducer is thus provided.

One embodiment of the present disclosure is a MEMS acoustic transducer device that includes a capacitive microelectromechanical sensing structure and a biasing circuit. The biasing circuit includes a voltage-boosting circuit, an insulating circuit element set between an output of the voltage-boosting circuit and the sensing structure, a pre-charge stage, and a first switch element set between a first output of said pre-charge stage and a first high-impedance node defined by a terminal of the sensing structure. The voltage-boosting circuit is configured to supply a boosted voltage on the output terminal. The insulating circuit element has a high impedance and is associated with the first high-impedance node. The pre-charge stage has a first output and is configured to generate on the first output a first pre-charge voltage as a function of, and distinct from, the boosted voltage. The first switch element is configured to selectively electrically couple the first high-impedance node to the first output during a start-up phase of the biasing circuit and thereby bias the first high-impedance node to the first pre-charge voltage.

BRIEF DESCRIPTION OF THE SEVERAL VIEWS OF THE DRAWINGS

For a better understanding of the present disclosure, preferred embodiments thereof are now described purely by way of non-limiting example and with reference to the attached drawings, wherein.

DETAILED DESCRIPTION

Figure 5:
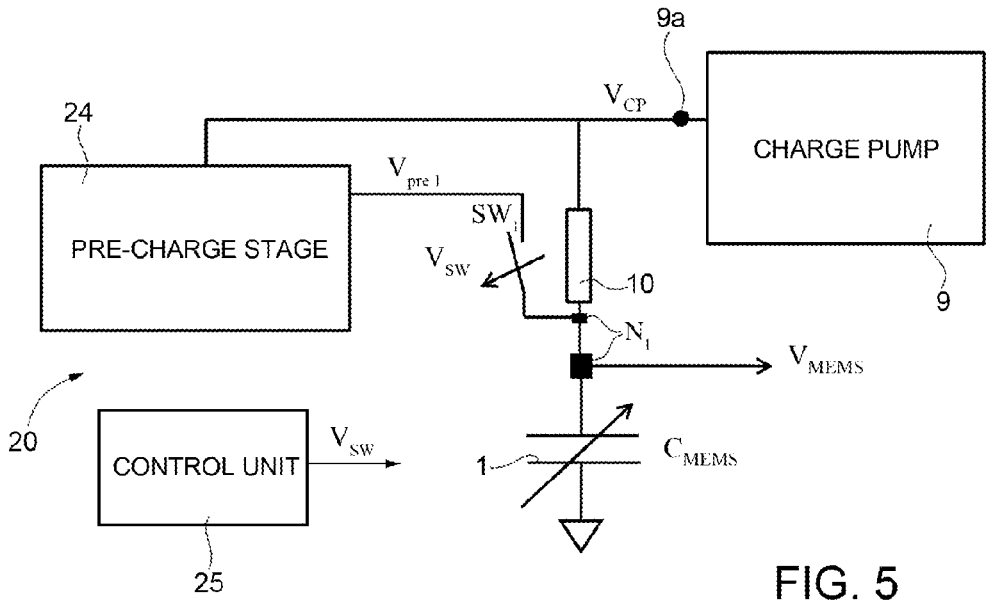
FIG. 5 is an overall circuit diagram of a biasing circuit of the acoustic transducer, according to an aspect of the present solution.

With reference first to FIG. 5 (where the same reference numbers are in general used for designating elements corresponding to others described previously), one aspect of the present solution envisages that the biasing circuit, here designated by 20, of the MEMS microphone is configured for pre-charging, during the start-up phase, at least one high-impedance node associated with the insulating circuit element 10 at a proper pre-charge voltage, i.e., at the voltage that the high-impedance node itself is to assume at the end of the start-up phase, on account of the presence of the leakage current $I_{LEAK}$ that flows in the same insulating circuit element 10.

In this way, at the end of the start-up phase, the high-impedance node is already substantially at the voltage that it is to assume due to the voltage drops determined by the leakage current $I_{LEAK}$, and there is no substantial delay due to discharge of the capacitor defined by the sensing structure 1 of the MEMS microphone.

In detail, the biasing circuit 20 comprises at least one first switch element $SW_1$, which may be controlled for connecting at least one high-impedance node associated to the insulating circuit element 10, in this case the first high-impedance node $N_1$ (connected to the first terminal of the sensing structure 1 of the MEMS microphone), to a pre-charge stage 24, which generates a first pre-charge voltage $V_{pre1}$, on a first output $Out_1$ thereof.

The pre-charge stage 24 is connected to the output terminal 9*a* of the charge-pump circuit 9 and receives the pump voltage $V_{CP}$, and is further configured to generate the first pre-charge voltage $V_{pre1}$ as a function of the value of the pump voltage $V_{CP}$.

In particular, the value of the pre-charge voltage $V_{pre1}$ is given by the following expression:

$$V_{pre1}=V_{CP}-R_B \cdot I_{LEAK}$$

where $R_B$ is the high resistance of the insulating circuit element 10.

During a phase of start-up of the biasing circuit 20 (for example, upon turning-on following supply of electrical energy or upon return from a stand-by or power-down condition), the first switch element $SW_1$ is closed by a control signal $V_{SW}$, so as to connect the first high-impedance node $N_1$ to the pre-charge stage 24 and bring the first high-impedance node $N_1$ to the first pre-charge voltage $V_{pre1}$. The insulating circuit element 10 is in this way by-passed.

Next, at the end of the start-up phase, the same first switch element $SW_1$ is driven into an opening condition by the control signal $V_{SW}$ so as basically to restore connection of the sensing structure 1 to the insulating circuit element 10 and, through the insulating circuit element 10, to the output terminal 9*a* of the charge-pump circuit 9.

The biasing circuit 20 thus comprises a control unit 25, which generates the control signal $V_{SW}$ for controlling closing and opening of the first switch element $SW_1$ with an appropriate timing, as a function of the timing of the start-up phase.

In a per se known manner, the end of the start-up phase may be for example established by the control unit 25 when a pre-set time interval elapses, or else when it is detected that the capacitance of the MEMS microphone is completely charged to a desired value, by monitoring the value of the voltage $V_{MEMS}$. For this purpose, the control unit 25 may be coupled electrically to the sensing structure 1 of the MEMS microphone for verifying the state of charge thereof.

Figure 6:
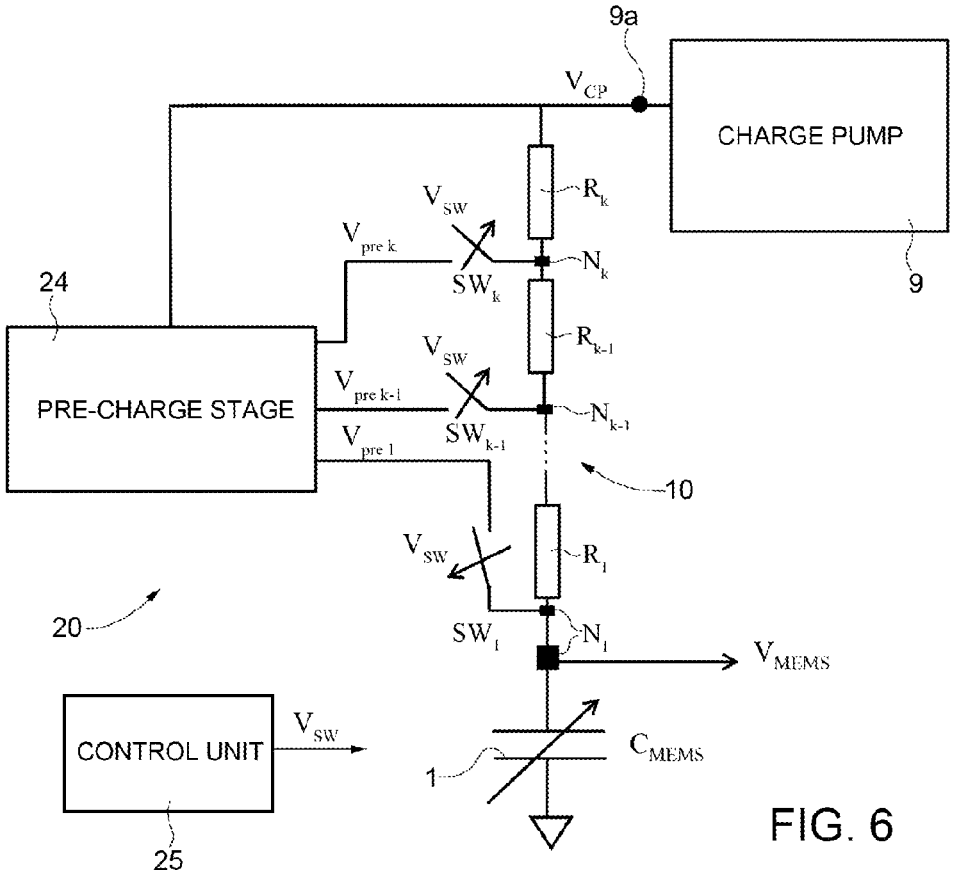
FIG. 6 is an overall circuit diagram of a biasing circuit, according to a further aspect of the present solution.

As illustrated in FIG. 6, the insulating circuit element 10 may conveniently comprise a number k (with k greater than or equal to one) of high-impedance cells $R_1, R_2, \ldots, R_k$, connected together in series, each cell providing in this case a portion of the overall high insulation impedance.

As mentioned previously, and as will be described more fully hereinafter, each cell may be implemented by means of the anti-parallel connection of a pair of diode elements.

The above solution is thus adopted, in the case where the signal developed on the first high-impedance node $N_1$ has an amplitude comparable to, or higher than, the voltage for turning on the diode elements forming the insulation impedance; in this case one can introduce one or more further cells connected in series, to prevent the condition of turning-on of the corresponding diode elements.

The high-impedance cells $R_1$-$R_k$ define between them a plurality of further high-impedance nodes $N_2$-$N_k$, associated to the insulating circuit element 10, in addition to the first high-impedance node $N_1$, connected to the first terminal of the sensing structure 1 of the MEMS microphone; the last high-impedance node $N_k$ is connected to the output terminal 9*a* of the charge-pump circuit 9 via a last high-impedance cell $R_k$.

In this embodiment, the pre-charge stage 24 is thus configured to pre-charge each one of the high-impedance nodes $N_1$-$N_k$ associated to the insulating circuit element 10 to a respective pre-charge voltage $V_{pre1}$-$V_{prek}$, generated by the pre-charge stage 24 on a respective output $Out_1$-$Out_k$.

The above pre-charge voltages $V_{pre1}$-$V_{prek}$ represent the voltage that the respective high-impedance nodes $N_1$-$N_k$ assume in conditions of normal operation (at the end of the start-up phase) owing to the presence of the leakage current $I_{LEAK}$ that flows through the insulating circuit element 10, and through the corresponding cells $R_1$-$R_k$.

In particular, the value of the generic pre-charge voltage $V_{pre1}$ (where the index i ranges from 1 to k) is given by:

$$V_{prei} = V_{CP} - I_{LEAK} \cdot \sum_{j=i}^{k} R_j$$

The biasing circuit 20 thus comprises a corresponding number of switch elements $SW_1$-$SW_k$, each of which receives, and is controlled by, the control signal $V_{SW}$, and is configured to selectively connect a respective high-impedance node $N_1$-$N_k$ to the pre-charge stage 24 for bringing the same high-impedance node $N_1$-$N_k$ to the respective pre-charge voltage $V_{pre1}$-$V_{prek}$ during the start-up phase.

Switch elements $SW_1$-$SW_k$ are thus driven together into a closing condition (during the start-up phase) or opening condition (at the end of the start-up phase) by the same control signal $V_{SW}$ generated by the control unit 25.

The values of the leakage current $I_{LEAK}$ may be determined in a reliable way in the design stage via simulation, for pre-set values of temperature and supply voltage, and for a pre-set manufacturing process (in this regard, it is emphasized that the specifications of start-up time of MEMS microphones are also provided for pre-set values of temperature and supply voltages).

If a higher precision is to be obtained, values of the leakage currents $I_{LEAK}$ may be determined starting from the measurement of some relevant parameters at the end of the manufacturing process, carried out directly on the die of semiconductor material, provided in which is the biasing circuit 20 (which, as mentioned previously, may be the same die as that in which also the read circuit associated to the MEMS microphone 1 is provided, or else a distinct die); for example, the start-up time, the detection sensitivity, or the noise behavior may be measured.

In this case, the possibility of adjusting the values of the pre-charge voltages $V_{pre1}$-$V_{prek}$ by means of appropriate adjustment elements that are present on the die and may be controlled from outside at the calibration stage, at the end of the manufacturing process, may be advantageous. For this purpose, the pre-charge stage 24 is thus able to generate the pre-charge voltages $V_{pre1}$-$V_{prek}$ with adjustable values, also as a function of regulating signals received at input.

In any case, the possibility of pre-charging the high-impedance nodes $N_1$-$N_k$ associated to the insulating circuit element 10 enables considerable reduction of the start-up times thanks to the fact that, once the switch elements $SW_1$-$SW_k$ are opened, the capacitor defined by the sensing structure 1 of the MEMS microphone has to compensate a substantially negligible voltage difference.

The present Applicant has further found that a drawback that may afflict the solution described, at least in certain operating conditions, is linked to charge injection (the so-called "feedthrough phenomenon") on the high-impedance nodes $N_1$-$N_k$, upon removal of the pre-charge condition, i.e., upon opening of the switch elements $SW_1$-$SW_k$.

It is known, in fact, that, in the case where the same switch elements $SW_1$-$SW_k$ are made by means of transistors, for example PMOS transistors, during turn-off, the charges accumulated in the channel of these transistors are injected into the source and drain terminals, generally to the same extent, thus leading to an increase of charge in the capacitor of the MEMS microphone.

Consequently, a deviation of the voltage $V_{MEMS}$ with respect to the correct final value may again arise, and an associated time delay due to the subsequent discharge of the capacitor (in a way similar to what has been discussed previously).

The present Applicant has, however, found that this drawback may be solved by means of an appropriate pattern of the control signal $V_{SW}$; in particular, the control unit 25 is configured to generate the aforesaid control signal $V_{SW}$ with a fast falling edge for determining, rapidly, closing of the switch elements $SW_1$-$SW_k$, but a slow rising edge for determining, slowly, opening of the same switch elements $SW_1$-$SW_k$ (and turn-off of the transistors that define the same switches).

In a way that will be evident to a person skilled in the field, a slow rising edge has a gradual rise, for example with a slope of less than a few volts per microsecond. In particular, the presence of the slow rising edge enables the charges stored in the channel of the transistors to flow along the path with lower impedance, in this case, evidently, the path towards the output terminal 9*a* of the charge-pump circuit 9 (given the very high impedance of the cells $R_1$-$R_k$ of the insulating circuit element 10).

Consequently, there is no increase of the charge stored in the capacitor of the MEMS microphone 1, and likewise there is no undesirable increase of the start-up time associated to the biasing circuit 20.

Figure 7:
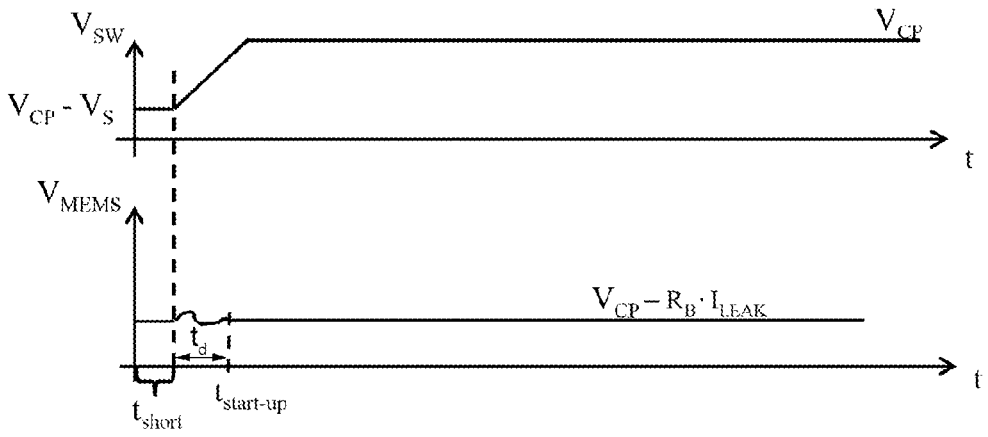
FIG. 7 shows the plot of the voltage supplied by the sensing structure of the acoustic transducer, during a start-up phase of the biasing circuit.

The reduction of the start-up time that the present solution affords is highlighted by the plots of FIG. 7.

In particular, FIG. 7 shows the plot of the control signal $V_{SW}$, and the corresponding slow rising edge upon turning-off of the switch elements $SW_1$-$SW_k$ (at the end of the time $t_{short}$), and further the corresponding plot of the voltage $V_{MEMS}$, on the first terminal of the sensing structure 1 of the MEMS microphone (and of the first high-impedance node $N_1$).

Figure 1:
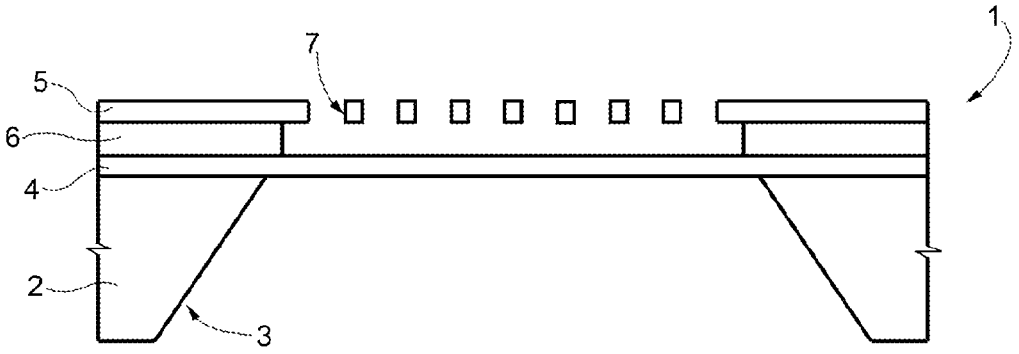
FIG. 1 (Prior Art)
FIG. 1 is a schematic cross-section of the microelectromechanical sensing structure of a capacitive acoustic transducer, of a known type.
Figure 2:
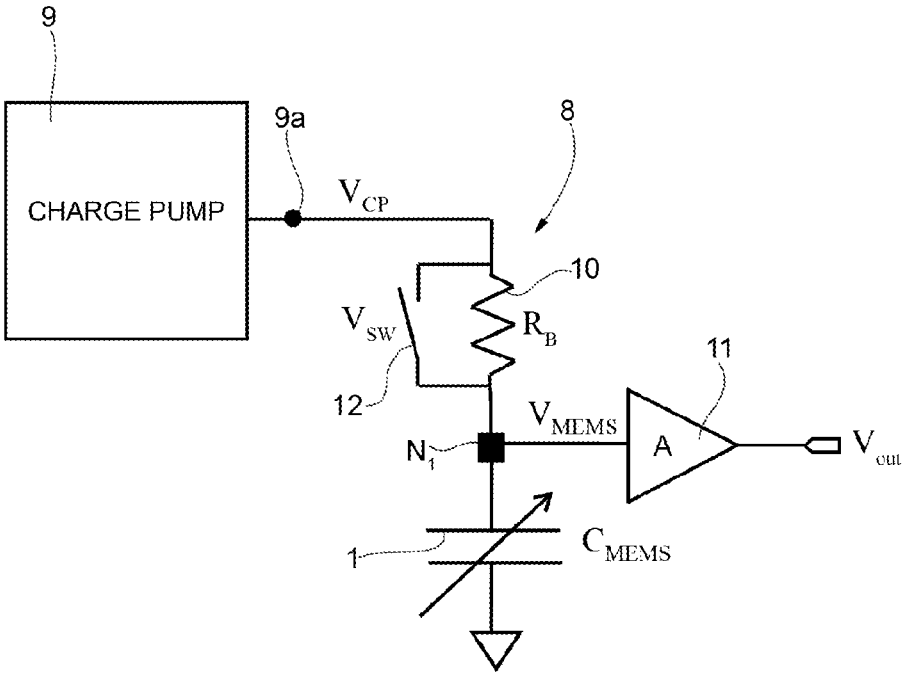
FIG. 2 (Prior Art)
FIG. 2 is an overall circuit diagram of a biasing circuit of the acoustic transducer, also of a known type.
Figure 3:
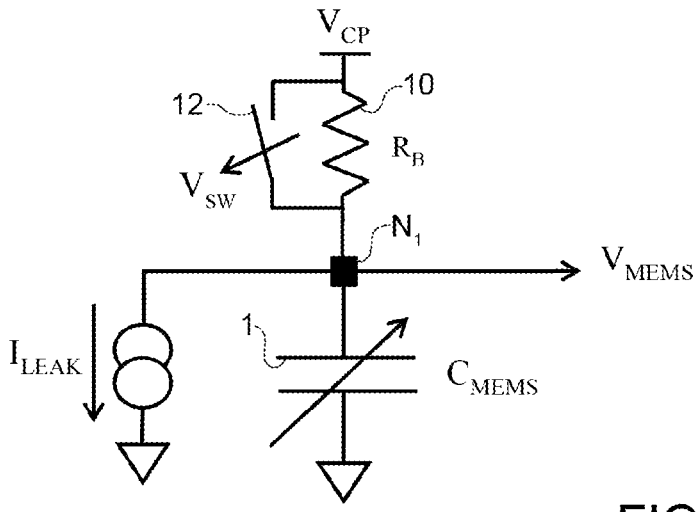
FIG. 3 (Prior Art)
FIG. 3 shows the presence of a leakage current in the biasing circuit of FIG. 2.
Figure 4:
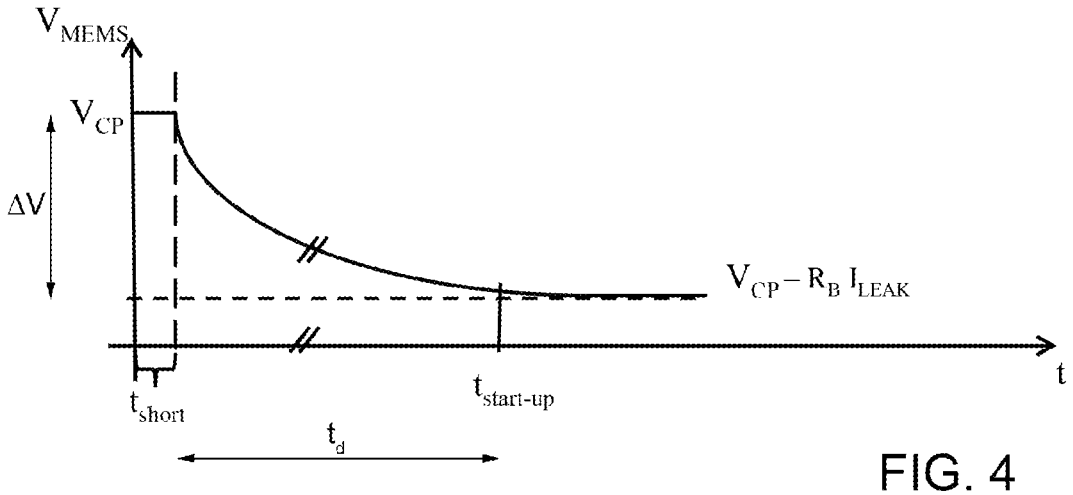
FIG. 4 (Prior Art)
FIG. 4 shows the plot of the voltage supplied by the sensing structure of the acoustic transducer, during a start-up phase of the biasing circuit.

Also evident, from a comparison with the similar FIG. 4, is the considerable reduction of the delay time $t_d$, in this case absent, or having a limited value due only to possible residual charge injections, or to a non-perfect correspondence between the values of the pre-charge voltages $V_{pre1}$-$V_{prek}$ with the real voltage values on the high-impedance nodes $N_1$-$N_k$ in normal operating conditions (at the end of the start-up phase).

In particular, the voltage $V_{MEMS}$ has, both during the start-up phase and during the normal operating phase, substantially the same value:

$$V_{MEMS}=V_{CP}-R_B \cdot I_{LEAK}$$

Figure 8:
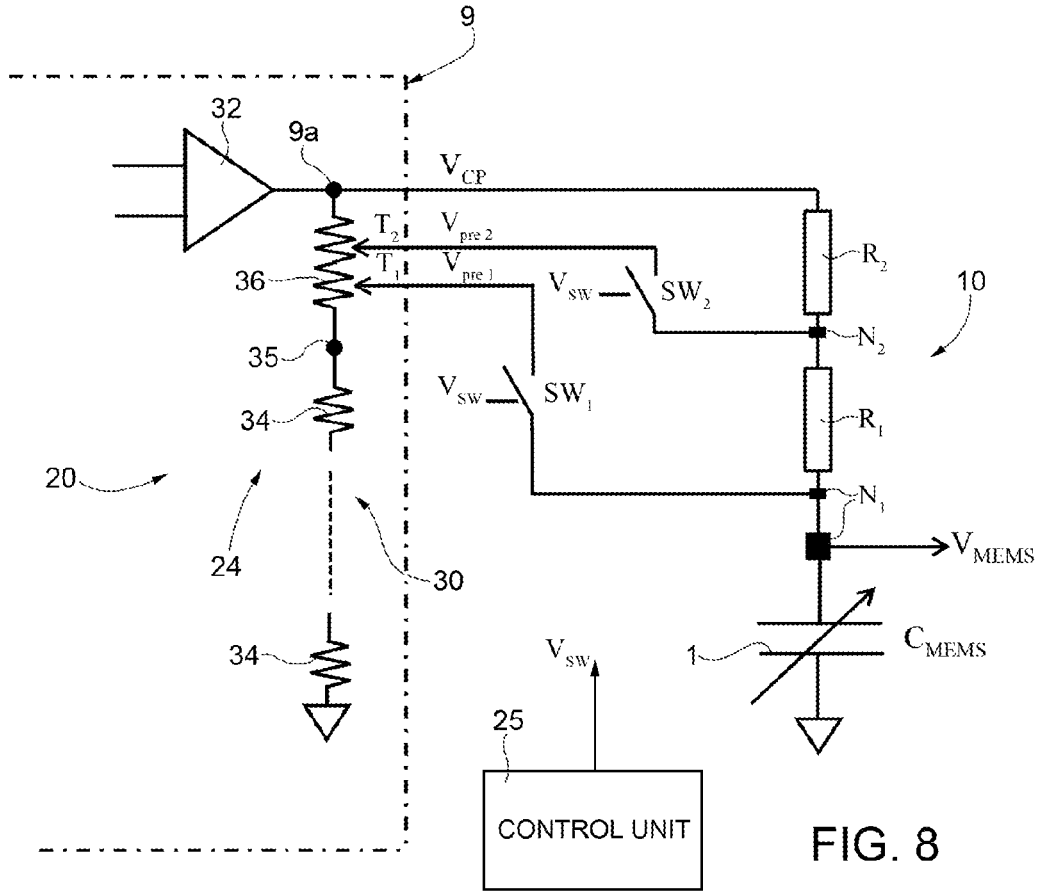
FIG. 8 shows a possible implementation of a stage of pre-charge voltage generation in the biasing circuit of FIG. 7.

A description is now made, with reference to FIG. 8, of a possible implementation of the pre-charge stage 24 for generation of the pre-charge voltages $V_{pre1}$-$V_{prek}$. Purely by way of example, FIG. 8 refers to an implementation of the insulating circuit element 10 with two cells in series, $R_1$ and $R_2$, associated with which are two high-impedance nodes $N_1$, $N_2$ (it is, however, evident that what will be discussed likewise applies to a generic implementation of the same insulating circuit element 10).

In detail, the pre-charge stage 24 comprises a voltage divider 30, connected to the output terminal 9*a* of the charge-pump circuit 9, and in particular to a final stage 32 of the charge-pump circuit 9 (of a known type, here represented schematically and not described in detail), which supplies the pump voltage $V_{CP}$.

The voltage divider 30 comprises: one or more divider resistor elements, designated as a whole by 34, connected together in series between the terminal at reference potential (ground) and an internal node 35; and an adjustment resistor element 36, connected in series with the aforesaid divider resistor elements 34, between the internal node 35 and the output terminal 9*a* of the charge-pump circuit 9.

The adjustment resistor element 36 has a number k of output taps T, which corresponds to the number of cells of the insulating circuit element 10, in this case, which is provided purely by way of example, two output taps, designated by $T_1$ and $T_2$.

Each output tap $T_1$, $T_2$ is electrically connected to a respective high-impedance node $N_1$, $N_2$ of the insulating circuit element 10, via a respective switch element $SW_1$, $SW_2$.

In an evident way, the output taps divide the value of resistance of the adjustment resistor element 36, and to each output tap $T_1$, $T_2$ a respective division ratio of the pump voltage $V_{CP}$ is thus associated, and an associated pre-charge voltage $V_{pre1}$, $V_{pre2}$ to which the respective high-impedance node $N_1$, $N_2$ may be selectively connected.

Advantageously, the value of resistance of the adjustment resistor element 36 is adjustable for adjusting accordingly the values of the pre-charge voltages $V_{pre1}$, $V_{pre2}$ on the high-impedance nodes $N_1$, $N_2$.

Figure 9:
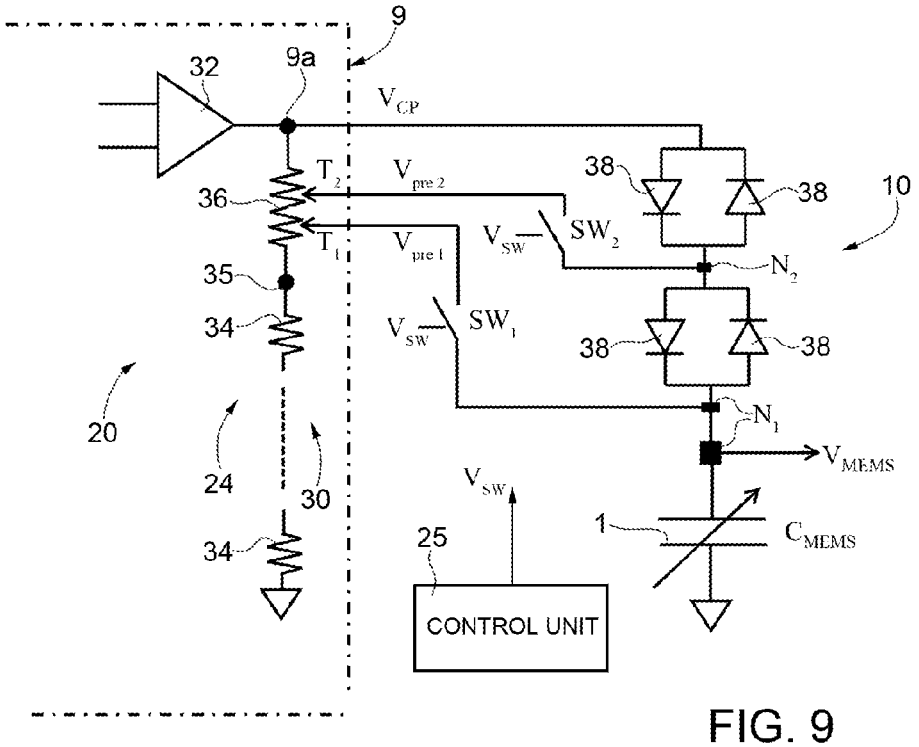
FIGS. 9-11 show possible implementations of a high-impedance insulating circuit element of the biasing circuit of FIG. 8.

FIG. 9 further shows a possible implementation of the cells of the insulating circuit element 10, with reference, purely by way of example, once again to the example of FIG. 8 (again, this solution may be extended to any number of cells).

Each cell is implemented by means of a pair of diode elements 38, in antiparallel configuration (i.e., the anode and cathode terminals of a first diode of the pair are connected to the cathode and anode terminals, respectively, of the second diode of the pair). In a per se known manner, when the diode elements are biased at a voltage across them such as not to drive them into conduction, they provide a high impedance between their anode and cathode terminals.

Figure 10:
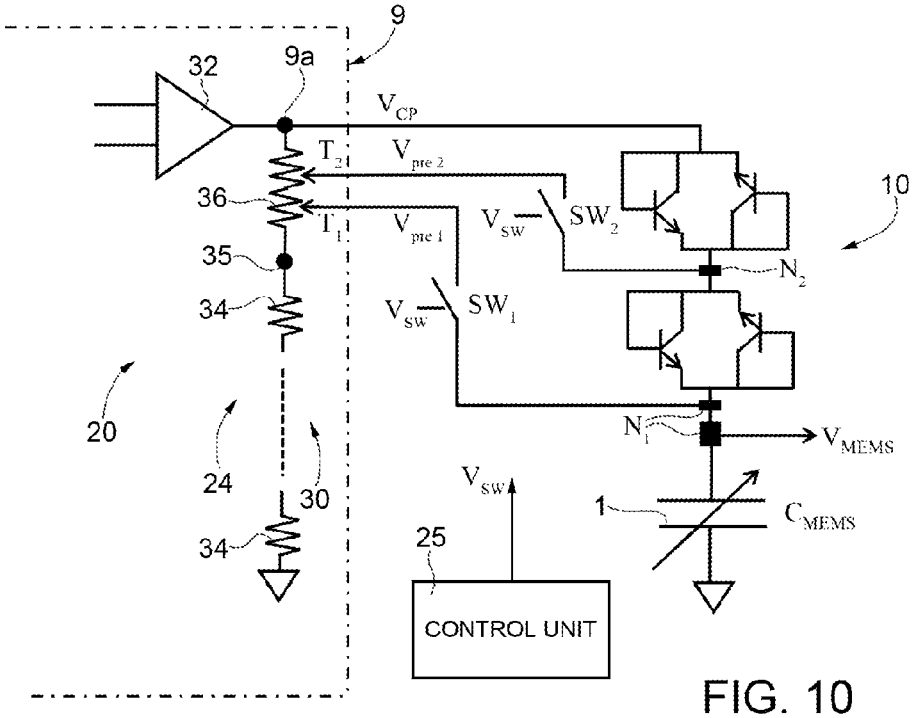
Figure 11:
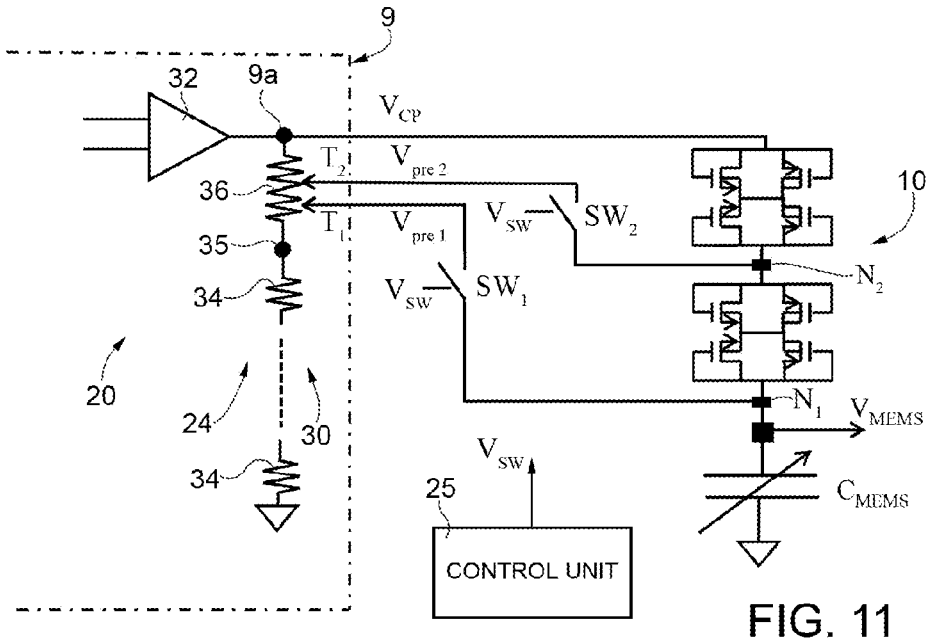

In a known manner, not described in detail herein, the pair of diode elements may further be implemented by means of bipolar transistors (BJTs) with the base and collector terminals electrically connected together, as illustrated in FIG. 10, or by means of CMOS transistors, with the gate and drain terminals electrically connected together, as illustrated in FIG. 11 (once again with reference, purely by way of example, to an insulating circuit element 10 with just two cells connected in series).

Figure 12:
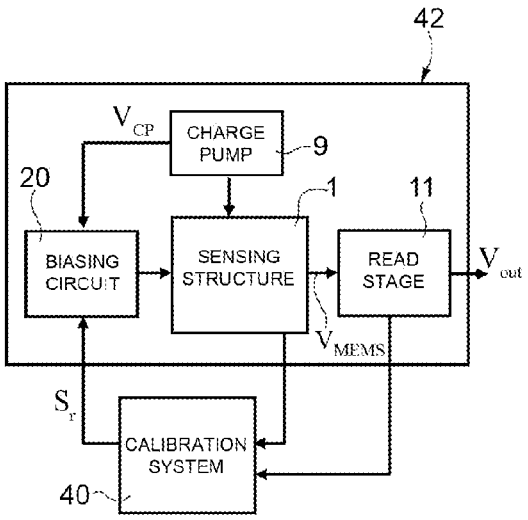
FIG. 12 is an overall block diagram of a calibration system of the acoustic transducer according to a further aspect of the present solution.

As shown in FIG. 12, a further aspect of the present solution envisages a calibration system 40, coupled to the MEMS microphone, designated herein by 42 and including, as highlighted previously: the sensing structure 1, the corresponding read circuit 11, the corresponding charge-pump circuit 9, and the corresponding biasing circuit 20 (where the read circuit 11, the charge-pump circuit 9, and the biasing circuit 20 may be made in the same die or in distinct dice, conveniently housed in the same package).

The calibration system 40 is electrically coupled to the read circuit 11 and to the MEMS microphone 1 and is configured to detect parameters of interest, such as the start-up time, the sensitivity or noise performance, at the end of the manufacturing process. The calibration system 40 is further coupled to the biasing circuit 20 in order to regulate, as a function of the parameters detected, the biasing conditions, and in particular the pre-charge voltages $V_{pre1}$ on the high-impedance nodes associated to the insulating circuit element 10, to reduce the start-up time.

For instance, the calibration system 40 may include a processing unit, which is designed to execute a computer program, for acquiring the parameters of interest and supplying regulating signals $S_r$ to the biasing circuit 20 for regulating the pre-charge voltages $V_{prei}$, implementing a feedback-control calibration process, possibly of an iterative type, i.e., in successive approximation steps.

The calibration system 40 may possibly be integrated in the same die as the one in which the charge-pump circuit 9, the read circuit 11, and/or the biasing circuit are provided, or else may be evidently provided in a corresponding test machine to enable execution of the calibration operations, at the end of the manufacturing process.

The advantages of what has been described previously are clear from the foregoing description.

In particular, it is emphasized once again how it is possible to achieve a considerable reduction in the start-up time in the operation of the MEMS microphone, due in particular to the corresponding biasing circuit.

A very short turning-on time is thus obtained, and the sensitivity of the MEMS microphone remains substantially constant, in particular preventing drifts of the same sensitivity during the start-up phase.

Figure 13:
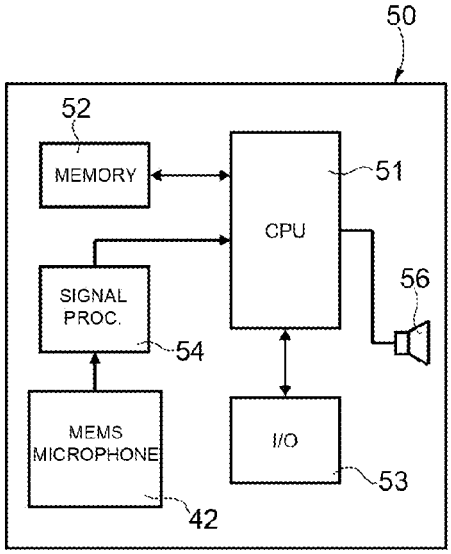
FIG. 13 is a schematic block diagram of an electronic device incorporating the acoustic transducer.

The characteristics discussed previously make the use of MEMS microphone 42 particularly advantageous in an electronic apparatus 50, as shown in FIG. 13 (the electronic apparatus 50 possibly comprising further MEMS microphones, in a way not illustrated).

The electronic apparatus 50 is preferably a mobile electronic device, such as, for example, a smartphone, a PDA, a tablet, or a notebook, but also a voice recorder, an audio player with voice-recording capacity, etc. Alternatively, the electronic apparatus 50 may be a hydrophone, which is able to work under water, or else a hearing-aid device.

The electronic apparatus 50 comprises a microprocessor 51, a memory block 52, connected to the microprocessor 51, and an input/output interface 53, for example equipped with a keypad and a display, which is also connected to the microprocessor 51. The MEMS microphone 42 communicates with the microprocessor 51 via a signal-processing block 54, connected to the read circuit 11 of the MEMS microphone 42, described previously (here not illustrated).

Furthermore, a speaker 56 may be present, for generating sounds on an audio output of the electronic apparatus 50.

Finally, it is clear that modifications and variations may be made to what has been described and illustrated herein, without thereby departing from the scope of the present disclosure.

In particular, the biasing circuit according to the present disclosure may advantageously be used with different types of capacitive acoustic transducers, both analog and digital.

Different circuit implementations may further be envisaged for the biasing circuit 20, in particular for the corresponding pre-charge stage 24.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A MEMS acoustic transducer device comprising:

a capacitive microelectromechanical sensing structure having a terminal; and a biasing circuit that includes:

a voltage-boosting circuit having an output terminal and configured to supply a boosted voltage on the output terminal, an insulating circuit element having a high impedance, set between said output terminal and the terminal of said sensing structure, the terminal of the sensing structure being a first high-impedance node associated with said insulating circuit element, a pre-charge stage having a first output and configured to generate on the first output a first pre-charge voltage as a function of, and distinct from, said boosted voltage; and a first switch element set between said first output of said pre-charge stage and said first high-impedance node, said first switch element being configured to selectively electrically couple said first high-impedance node to said first output during a start-up phase of said biasing circuit and thereby bias said first high-impedance node to said first pre-charge voltage.

2. The device according to claim 1, wherein said pre-charge stage is configured to generate said first pre-charge voltage as a function of said boosted voltage and of a leakage current that in use flows through said insulating circuit element.

3. The device according to claim 2, wherein the pre-charge stage is configured to produce said first pre-charge voltage at a value substantially equal to the boosted voltage decreased by a voltage drop generated by said leakage current on said insulating circuit element.

4. The device according to claim 1, wherein:

said insulating circuit element includes first and second high-impedance resistor elements electrically coupled together in series by a second high-impedance node;

said pre-charge stage is configured to generate a second pre-charge voltages on a second output of the pre-charge stage; and said biasing circuit includes a second switch element set between said second high-impedance node and said second output of said pre-charge stage, and configured to bias said second high-impedance node at said second pre-charge voltage during said start-up phase of said biasing circuit.

5. The device according to claim 4, wherein said pre-charge stage is configured to generate said first pre-charge voltage as a function of said boosted voltage and of a first leakage current that in use flows through the first high-impedance resistor element and generate the second pre-charge voltage as a function of said boosted voltage and of a second leakage current that in use flows through the second high-impedance resistor element.

6. The device according to claim 1, wherein said biasing circuit further comprises a control unit configured to generate a control signal that controls said first switch element into a closing condition during said start-up phase, and into an opening condition at an end of said start-up phase; wherein said control signal has a first, fast, switching edge for driving said first switch element into the closing condition, and a second, slow, switching edge for driving said first switch element into the opening condition.

7. The device according to claim 1, wherein said pre-charge stage includes a voltage divider electrically coupled to the output terminal of said voltage-boosting circuit and is configured to generate said first pre-charge voltage by at least one division of said boosted voltage.

8. The device according to claim 7, wherein said voltage divider comprises an adjustable resistor element configured to enable adjustment of a value of said at least one division for generation of said first pre-charge voltage.

9. The device according to claim 7, wherein said pre-charge stage is configured to generate a number of further pre-charge voltages on respective further outputs; and wherein said voltage divider comprises an adjustable resistor element that has a number of output taps corresponding to the further outputs, each output tap defining a respective division ratio and a respective one of said further pre-charge voltages.

10. The device according to claim 1, wherein said insulating circuit element comprises a high-impedance resistor element and includes a pair of diode elements in antiparallel configuration.

11. The device according to claim 10, wherein said diode elements are provided by respective bipolar or CMOS transistors.

12. The device according to claim 1, further comprising a calibration unit coupled to said biasing circuit and configured to supply a regulation signal that regulates said first pre-charge voltage; wherein said calibration unit, during a calibration procedure, is configured to measure an electrical parameter associated with said sensing structure or with an electronic read circuit associated with the sensing structure, and to generate said regulation signal as a function of said electrical parameter.

13. The device according to claim 1, comprising a controller configured to initiate said start-up phase occurs upon turning-on of the biasing circuit or upon return of the biasing circuit from an energy-saving condition.

14. An electronic apparatus, comprising:

a MEMS acoustic transducer device that includes:

a capacitive microelectromechanical sensing structure having a terminal; and a biasing circuit that includes:

a voltage-boosting circuit having an output terminal and configured to supply a boosted voltage on the output terminal, an insulating circuit element having a high impedance, set between said output terminal and the terminal of said sensing structure, the terminal of the sensing structure being a first high-impedance node associated with said insulating circuit element, a pre-charge stage having a first output and configured to generate on the first output a first pre-charge voltage as a function of, and distinct from, said boosted voltage; and a first switch element set between said first output of said pre-charge stage and said first high-impedance node, said first switch element being configured to selectively electrically couple said first high-impedance node to said first output during a start-up phase of said biasing circuit and thereby bias said first high-impedance node to said first pre-charge voltage; and a processor coupled to the MEMS acoustic transducer device.

15. The electronic apparatus of claim 14, where said electronic apparatus is a smartphone, a PDA, a tablet, a notebook, a voice recorder, an audio player with voice-recording capacity, a hydrophone, or a hearing-aid device.

16. The electronic apparatus of claim 14, wherein:

said insulating circuit element includes first and second high-impedance resistor elements electrically coupled together in series by a second high-impedance node;

said pre-charge stage is configured to generate a second pre-charge voltages on a second output of the pre-charge stage; and said biasing circuit includes a second switch element set between said second high-impedance node and said second output of said pre-charge stage, and configured to bias said second high-impedance node at said second pre-charge voltage during said start-up phase of said biasing circuit.

17. The electronic apparatus of claim 16, wherein said pre-charge stage is configured to generate said first pre-charge voltage as a function of said boosted voltage and of a first leakage current that in use flows through the first high-impedance resistor element and generate the second pre-charge voltage as a function of said boosted voltage and of a second leakage current that in use flows through the second high-impedance resistor element.

18. The electronic apparatus of claim 14, wherein said biasing circuit further comprises a control unit configured to generate a control signal that controls said first switch element into a closing condition during said start-up phase, and into an opening condition at an end of said start-up phase; wherein said control signal has a first, fast, switching edge for driving said first switch element into the closing condition, and a second, slow, switching edge for driving said first switch element into the opening condition.

19. The electronic apparatus of claim 14, wherein said pre-charge stage includes a voltage divider electrically coupled to the output terminal of said voltage-boosting circuit and is configured to generate said first pre-charge voltage by at least one division of said boosted voltage.

20. A method, comprising:

biasing a MEMS acoustic transducer device that includes:

a capacitive microelectromechanical sensing structure; and a biasing circuit including a voltage-boosting circuit configured to supply a boosted voltage on an output terminal, and a high-impedance insulating circuit element set between said output terminal and a terminal of said sensing structure, the terminal of the sensing structure defining a first high-impedance node associated with said insulating circuit element, wherein the biasing includes:

generating a first pre-charge voltage as a function of, and distinct from, said boosted voltage; and pre-charging said first high-impedance node at said first pre-charge voltage during a phase of start-up of said biasing circuit.

21. The method according to claim 20, wherein generating said first pre-charge voltage includes generating said first pre-charge voltage as a function of said boosted voltage and of a leakage current that in use flows through said insulating circuit element.

* * * * *